United States Patent [19]

Iida et al.

[11] Patent Number: 4,726,444

[45] Date of Patent: Feb. 23, 1988

[54] SOUND WAVE CONTROL DEVICE

[75] Inventors: Kazuyoshi Iida; Keiichiro Mizuno; Kazuo Kondo, all of Yokohama, Japan

[73] Assignee: Bridgestone Corporation, Tokyo, Japan

[21] Appl. No.: 904,852

[22] Filed: Sep. 8, 1986

Related U.S. Application Data

[63] Continuation of Ser. No. 751,649, Jul. 3, 1985, abandoned.

[30] Foreign Application Priority Data

Jul. 6, 1984 [JP] Japan ..... 59-139072

[51] Int. Cl.[4] ..... G10K 11/00

[52] U.S. Cl. ..... 181/176; 181/175

[58] Field of Search ..... 181/176, 175

[56] References Cited

U.S. PATENT DOCUMENTS

| | | | |
|---|---|---|---|
| 2,684,724 | 7/1954 | Kock | 181/176 |
| 3,735,336 | 5/1973 | Long | 181/176 X |
| 3,957,134 | 5/1976 | Daniel | 181/176 |

*Primary Examiner*—Benjamin R. Fuller

*Attorney, Agent, or Firm*—Sughrue, Mion, Zinn, Macpeak, and Seas

[57] ABSTRACT

Disclosed herein is a sound wave control device which is shaped in a lens form or a prism form from an acoustically rigid porous material, wherein numerous paths having different path lengths are provided and the apparent medium density is varied. This second wave control device is used to improve the sound quality and the directivity of the sound waves from a speaker and the directional control of noises.

7 Claims, 12 Drawing Figures

SOUND WAVE CONTROL DEVICE

This is a continuation of Ser. No. 751,649, filed on July 3, 1985, now abandoned.

BACKGROUND OF THE INVENTION (1) Field of the Invention

The present invention relates to a sound wave control device, and can be used for reducing noise and improving sound quality and directivity of a speaker through controlling the propagating direction and phase of the sound waves generated from a relatively small size noise source of office machines, and speakers, and so on.

(2) Description of the Prior Art

As the noise control device for reducing the noise, there have been conventionally known the lens- or prism-shaped noise control devices having numerous hollow conduit paths of different conduit path lengths, for instance, from Japanese Patent Publication No. 47,162/1980 and Japanese Utility Model Registration Publication No. 24,716/1983.

However, according to the structure of the noise control device in which differences in the conduit path length are provided by piling pipe members, parallel partition plates, or the like to form a hollow body with a number of hollow conduit paths and shaping the thus obtained hollow body into a lens or prism form as described in the above publications, unfavorably it is necessary to provide very long hollow conduit paths due to the relation to the wavelength in order to control even low frequency waves, thereby rendering the sound wave control device bulky.

SUMMARY OF THE INVENTION

An object of the present invention is to obviate the above-mentioned problems, and more specifically the object of the invention is to provide a sound wave control device which is a small size with extremely long path lengths and enhanced sound wave-retarding effect, and has extremely large apparent path differences to converge or disperse and sound waves, so that the sound wave control device can used for controlling the direction of the noises and improving the sound quality and the directivity of sound waves from the speaker.

According to the present invention, there is a provision of a sound wave control device in which an acoustically rigid porous material such as ceramic foam, metal foam, metal fibers, metal particles, ceramic particles, or resin-cured foam with a few amount of residual membranes is shaped into a lens form or a prism form, or the acoustically rigid porous material is filled into a lens-shaped or prism-shaped frame box with an incidental face side and an irradiating face side being opened, whereby numerous paths having different path lengths are formed and the apparent medium density is varied, instead of the conduit path length differences being formed by the conduit members or parallel partition plates.

These and other objects, features and advantages of the invention will be well appreciated upon reading of the following description of the invention when taken in connection with the attached drawings with understanding that some modifications, variations and changes of the invention could be easily done by the skilled in the art to which the invention pertains without departing from the spirit of the invention or the scope of claims appended hereto.

BRIEF DESCRIPTION OF THE DRAWINGS

For better understanding of the invention, reference is made to the drawings, wherein.

DETAILED DESCRIPTION OF THE INVENTION

Figure 1A:
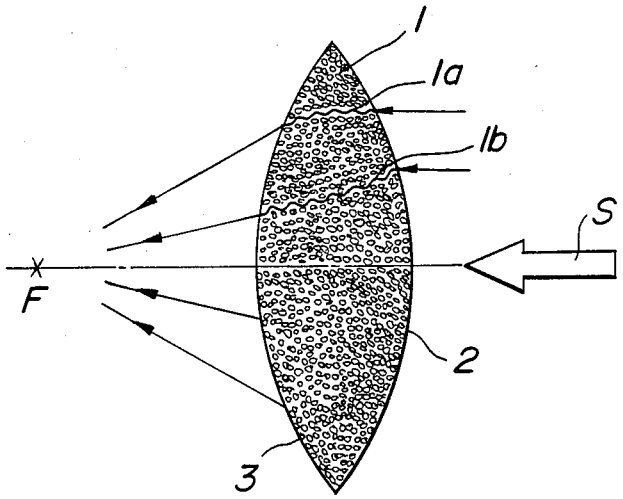
FIGS. 1(A), (B) and (C) are sectional views of sound wave control devices according to the present invention.

The invention will be explained more in detail with referring to specific embodiments shown in the attached drawings.

An acoustically rigid porous material constituting the sound wave control device according to the present invention is a material which is low in the ventilation resistance and the acoustic transmission loss and forms roundabout paths in a maze type or in a barrier type to exert the retarding action upon the sound waves propagating through the paths thus formed and which varies the apparent medium density. For instance, use may be favorably made of ceramic foam, a metal foam, metal fibers, metal particles, ceramic particles, a resin-cured foam which has a small amount of residual membranes and so on.

The above-recited acoustically rigid porous materials appropriately selected, and shaped in a lens form or a prism form in the ordinary manner. For example, ceramic foam has been known, for instance, from Japanese Patent Application Laid Open No. 77,114/1977. According to this Japanese Patent Application, the ceramic foam is produced by immersing polyurethane foam consisting of only a skeleton with no cell membranes into a hydrolyzing solution to hydrolyze the surface of the skeleton, removing the remaining solution on the skeleton through washing with water, attaching a slurry of ceramic raw material fine particles to the skeleton, solidifying the attached ceramics through drying, and sintering the resultant at a higher temperature while the polyurethane foam skeleton is removed through carbonization. As the metal foam, KALME (trade name: manufactured by NBC Corporation) may be used.

[Effects]

The large apparent differences in the path lengths are obtained by shaping a lens form or a prism form from the above-mentioned porous material. Thus, the noise-reducing effect can be also obtained with respect to the low frequency noises by even a small size and thin thickness sound wave control device. Further, as in the case with the optical lens or prism, the sound wave control device according to the present invention has the effects that the thicker the lens portion the more are the sound waves retarded, converged to the focus thereof and irradiated to have the directional control function and the phase control function, so that when the sound wave control device is attached to the front face of an audio speaker, the directivity or the phase conditions can be improved to enhance the acoustic performance of the acoustic devices. Moreover, the sound wave control device can be alternatively attached in front of the noise source or a noise-leaking opening of a noise generating chamber in which the noise source is present, such as an engine room, a pump chamber or the like to perform the directivity in such a manner that the noises may not propagate to the sound-receiving point.

The invention will be explained with referring to the specific embodiments shown in the attached drawings which are merely illustrative of the invention but never interpreted to limit the scope thereof.

Figure 1B:
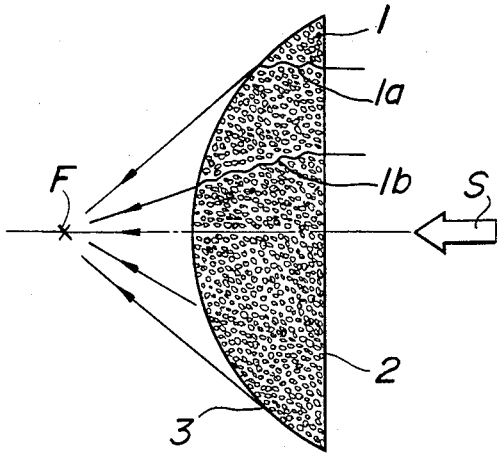
Figure 1C:
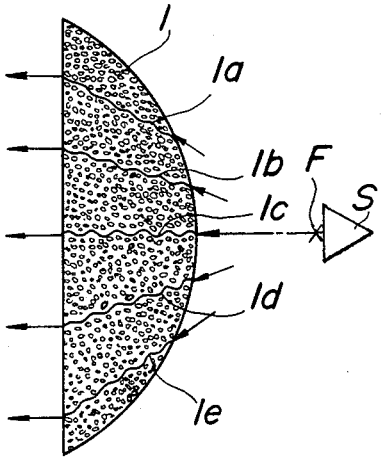
Figure 2:
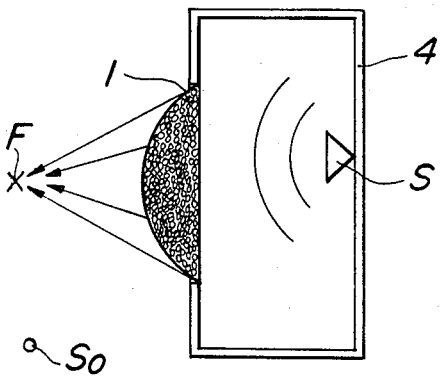
FIG. 2 is a schematic illustration of an embodiment in which the sound wave control device in FIG. 1(B) is uses for noise controlling.
Figure 3:
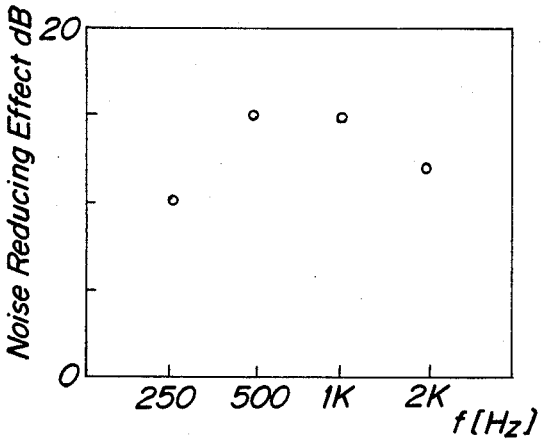
FIG. 3 is a graph showing a noise-reducing effect obtained by the sound wave control device shown in FIG. 2.
Figure 4:
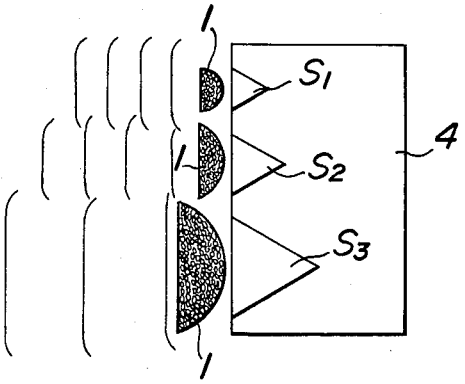
FIG. 4 is a schematic illustration of an embodiment in which the sound wave control devices as shown in FIG. 1(C) are used in the control of the sound quality of a speaker.

FIGS. 1–4 show embodiments according to the present invention. FIGS. 1(A), (B) and (C) illustrate the embodiments in which a ceramic foam is shaped into a convex lens and numerous roundabout path 1*a*, 1*b*, . . . having different path lengths are formed. By thus forming the sound wave control device in a convex lens shape, the sound S entering from the incidental face side 2 change the propagating direction and causes shape retarding while passing through the paths 1*a*, 1*b*, . . . , having the different path lengths. As shown in FIG. 1(B), the converging action is obtained by designing the incidental face 2 as a plane, and as shown in FIG. 2, it can be used in controlling noises. Further, as shown in FIG. 1(C), the parallel waves can be obtained in designing the irradiating face 3 as a plane, and the noise device can be used for controlling the sound quality of the speaker or the like as shown in FIG. 4.

In FIG. 2 is shown an embodiment in which the sound wave control device 1 of the convex lens shape shown in FIG. 1(B) is attached to the front face of a speaker box 4 while the plane is taken as the incidental face to control the noises. Sound waves from a sound source S are converged to a focus F, so that the sound level of sounds propagating to the sound receiving point $S_0$ can be reduced. FIG. 3 shows the noise-reducing effect attained at the sound-receiving point $S_0$ by installing the sound wave control device 1.

FIG. 4 shows an embodiment in which the convex lens-shaped sound wave control devices 1 as shown in FIG. 1 are attached to the front face of a speaker box 4, corresponding to a tweeter speaker $S_1$, a middle range speaker $S_2$ and a woofer speaker $S_3$ while their planes are taken as the irradiation faces respectively. By doing so, the wave fronts are controlled and the sounds are homogenized to improve the sound quality.

Figure 5A:
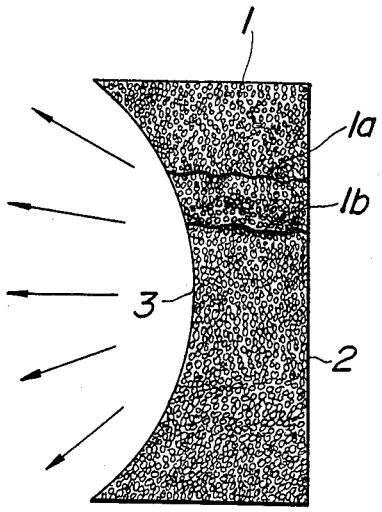
FIGS. 5(A) and (B) are vertically sectional views of other embodiments of concave lens-shaped sound wave control devices according to the present invention.
Figure 5B:
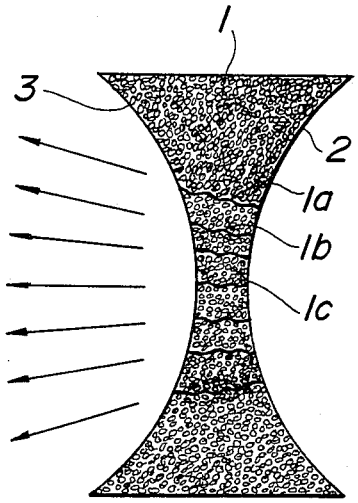

FIGS. 5(A) and (B) illustrate embodiments in which ceramic foam is shaped into a concave lens in which numerous roundabout paths 1*a*, 1*b*, . . . having different path lengths are formed. The dispersing effect can be obtained by designing the sound wave control device in a concave lens form.

Figure 6:
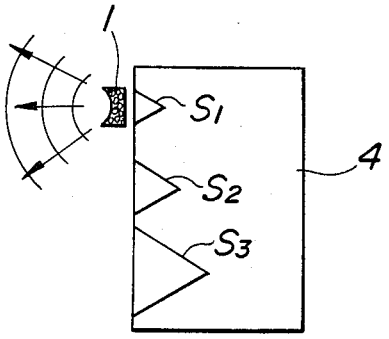
FIG. 6 is a schematic illustration of a further embodiment in which the sound wave control device shown in FIG. 5(A) is used in controlling a speaker.

FIG. 6 is an embodiment in which a concave lens-shaped sound wave control device 1 is attached to the front face of the speaker box and opposed to the tweeter speaker $S_1$. By arranging the sound wave control device like this, the sounds are dispersed to improve the directivity.

Figure 7A:
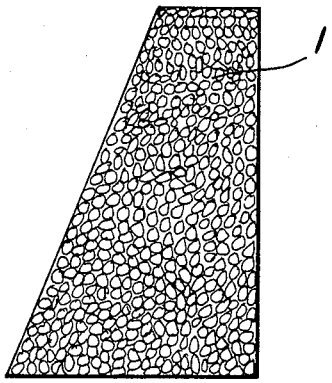
FIGS. 7(A) and (B) are vertically sectional views of prism-shaped sound wave control devices according to the present invention.
Figure 7B:
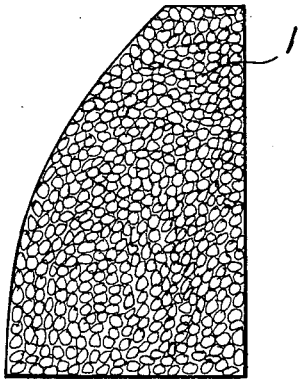

FIGS. 7(A) and (B) show embodiments in which ceramic foam is shaped into a prism form in which numerous roundabout paths 1*a*, 1*b*, . . . having different path lengths are provided.

Figure 8:
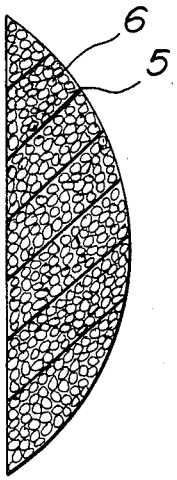
FIG. 8 is a vertically sectional view of a still further embodiment according to the present invention.

FIG. 8 is an embodiment in which plural conduit paths 5 having different conduit path lengths are assembled together in a form of a convex lens, and the acoustically rigid porous material such as ceramic foam, ceramic particles, metal foam, metal fibers, or resin-cured foam having a small amount of residual membranes is filled into the hollow conduit path 5. By so constituting, the lengths of the paths through which sound waves pass, the effective path is prolonged to effectively control the low frequency waves.

The sound wave control device according to the present invention is small in size with an extremely long path length and enhanced sound wave-retarding effect, and has large apparent differences in the path length to converge on disperse the sound waves, so that the sound wave control device can be used to improve the sound quality and the directivity of the sound waves from the speaker in addition to the directional control of the noises.

What is claimed is:

1. A sound wave control device which is shaped in a lens form or a prism form from an acoustically rigid porous material having a predetermined actual medium density selected from the group consisting of ceramic foam, metal foam, metal fibers, metal particles, and ceramic particles, wherein numerous paths having different path lengths are provided to exert a phase retarding action upon sound waves propagating through said acoustically rigid porous material such that it functions as though it had a density different from that of its actual medium density.

2. A sound wave control device according to claim 1, wherein conduit paths are provided in said sound control device shaped in a lens form or a prism form and extend from a sound extending face to a sound emitting face thereof.

3. A sound wave control device according to claim 1, wherein said lens form is convex.

4. A sound wave control device according to claim 1, wherein said lens form is concave.

5. A sound wave control device which is shaped in a lens form or a prism form from an acoustically rigid porous material having a predetermined actual medium density selected from the group consisting of ceramic foam, metal foam, metal fibers, metal particles, ceramic particles and resin-cured foam having a small amount of residual membranes, wherein numerous paths having different path lengths are provided to exert a phase retarding action upon sound waves propagating through said acoustically rigid porous material such that it functions as though it had a density different from that of its actual medium density; conduit paths provided in the sound control device in said lens form or said prism form and extending from a sound entering face to a sound emitting face thereof.

6. A sound wave control device according to claim 5, wherein said lens form is convex.

7. A sound wave control device according to claim 5, wherein said lens form is concave.

* * * * *